US007880704B2

(12) United States Patent
Speirs et al.

(10) Patent No.: US 7,880,704 B2
(45) Date of Patent: Feb. 1, 2011

(54) ENERGY SAVING PASSIVE MATRIX DISPLAY DEVICE AND METHOD FOR DRIVING THE COLUMN VOLTAGE HAVING REDUCED TRANSITIONS

(75) Inventors: Christopher Rodd Speirs, Zurich (CH); Martin Lienhard, Oberentfelden (CH)

(73) Assignee: NXP B.V., Eindhoven (NL)

( * ) Notice: Subject to any disclaimer, the term of this patent is extended or adjusted under 35 U.S.C. 154(b) by 988 days.

(21) Appl. No.: 10/559,914

(22) PCT Filed: May 27, 2004

(86) PCT No.: PCT/IB2004/050790

§ 371 (c)(1),
(2), (4) Date: Jun. 15, 2006

(87) PCT Pub. No.: WO2004/111987

PCT Pub. Date: Dec. 23, 2004

(65) Prior Publication Data

US 2006/0274004 A1 Dec. 7, 2006

(30) Foreign Application Priority Data

Jun. 12, 2003 (EP) ..... 03101708

(51) Int. Cl.
*G09G 3/36* (2006.01)

(52) U.S. Cl. ..... 345/89; 349/86

(58) Field of Classification Search ..... 345/3.1, 345/87–89, 94–100, 208–211, 690–961, 345/671; 349/86
See application file for complete search history.

(56) References Cited

U.S. PATENT DOCUMENTS

| | | | | |
|---|---|---|---|---|
| 4,769,713 | A * | 9/1988 | Yasui | 348/791 |
| 4,827,255 | A * | 5/1989 | Ishii | 345/692 |
| 5,068,649 | A * | 11/1991 | Garrett | 345/89 |
| 5,185,602 | A * | 2/1993 | Bassetti et al. | 345/89 |
| 5,485,173 | A * | 1/1996 | Scheffer et al. | 345/100 |
| 5,777,590 | A * | 7/1998 | Saxena et al. | 345/89 |
| 6,094,184 | A * | 7/2000 | Okamoto | 345/89 |
| 6,175,355 | B1 * | 1/2001 | Reddy | 345/691 |
| 6,927,785 | B2 * | 8/2005 | Kobayashi | 345/691 |

* cited by examiner

*Primary Examiner*—Amare Mengistu
*Assistant Examiner*—Vinh Lam

(57) ABSTRACT

Method of driving a liquid crystal display by supplying selectable column voltages Gj(t) from a predetermined number of column voltages levels, selection signals to groups of mutually orthogonal p rows (p≧1) for the duration of a row selection time p×nfrc during a superframe nfrc to generate grey scales. The column voltage is calculated depending on the grey scales of the p pixels in a column and on the mutually orthogonal selection signals Fi for the corresponding group of rows. The row selection time is subdivided in npwm sub selection time. The grey scales are coded in grey scale tables having nfrc phases with npwm. The superframes grey scales are generated using phase mixing. The change in the column voltage level defines a transition. The column voltage has always less transitions per row selection time than the number npwm of sub selection time of the row selection time.

13 Claims, 4 Drawing Sheets

| Grey Scale | Phase and Subslot | | | | | | | | | | | | | | | |
|---|---|---|---|---|---|---|---|---|---|---|---|---|---|---|---|---|
| | 0 | | | | 1 | | | | 2 | | | | 3 | | | |
| | 0 | 1 | 2 | 3 | 0 | 1 | 2 | 3 | 0 | 1 | 2 | 3 | 0 | 1 | 2 | 3 |
| 0 | 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 1 | 0 | 0 | 0 |
| 2 | 0 | 0 | 0 | 0 | 0 | 0 | 0 | 0 | 0 | 0 | 0 | 0 | 1 | 1 | 0 | 0 |
| 3 | 0 | 0 | 0 | 0 | 0 | 0 | 0 | 0 | 0 | 0 | 0 | 0 | 1 | 1 | 1 | 0 |
| 4 | 0 | 0 | 0 | 0 | 1 | 1 | 1 | 1 | 0 | 0 | 0 | 0 | 0 | 0 | 0 | 0 |
| 5 | 0 | 0 | 0 | 0 | 1 | 1 | 1 | 1 | 0 | 0 | 0 | 0 | 1 | 0 | 0 | 0 |
| 6 | 0 | 0 | 0 | 0 | 1 | 1 | 1 | 1 | 0 | 0 | 0 | 0 | 1 | 1 | 0 | 0 |
| 7 | 0 | 0 | 0 | 0 | 1 | 1 | 1 | 1 | 0 | 0 | 0 | 0 | 1 | 1 | 1 | 0 |
| 8 | 1 | 1 | 1 | 1 | 0 | 0 | 0 | 0 | 1 | 1 | 1 | 1 | 0 | 0 | 0 | 0 |
| 9 | 1 | 1 | 1 | 1 | 0 | 0 | 0 | 0 | 1 | 1 | 1 | 1 | 1 | 0 | 0 | 0 |
| 10 | 1 | 1 | 1 | 1 | 0 | 0 | 0 | 0 | 1 | 1 | 1 | 1 | 1 | 1 | 0 | 0 |
| 11 | 1 | 1 | 1 | 1 | 0 | 0 | 0 | 0 | 1 | 1 | 1 | 1 | 1 | 1 | 1 | 0 |
| 12 | 1 | 1 | 1 | 1 | 1 | 1 | 1 | 1 | 1 | 1 | 1 | 1 | 0 | 0 | 0 | 0 |
| 13 | 1 | 1 | 1 | 1 | 1 | 1 | 1 | 1 | 1 | 1 | 1 | 1 | 1 | 0 | 0 | 0 |
| 14 | 1 | 1 | 1 | 1 | 1 | 1 | 1 | 1 | 1 | 1 | 1 | 1 | 1 | 1 | 0 | 0 |
| 15 | 1 | 1 | 1 | 1 | 1 | 1 | 1 | 1 | 1 | 1 | 1 | 1 | 1 | 1 | 1 | 1 |
FIG. 5
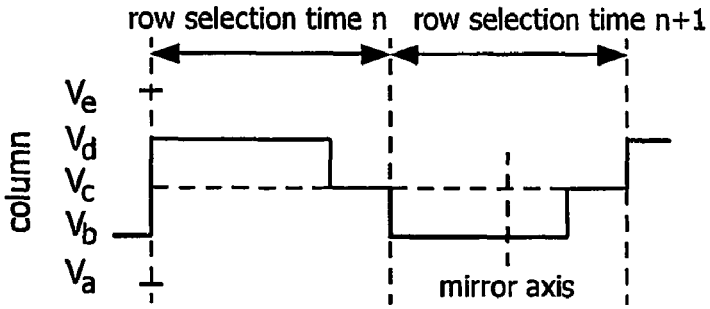
FIG. 6a
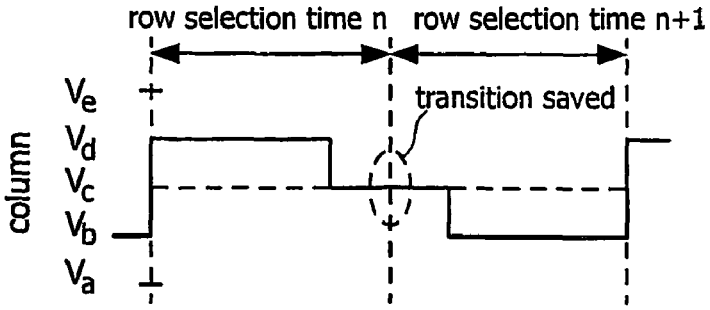
FIG. 6b

ENERGY SAVING PASSIVE MATRIX DISPLAY DEVICE AND METHOD FOR DRIVING THE COLUMN VOLTAGE HAVING REDUCED TRANSITIONS

The present invention concerns generally passive matrix displays, in particular to a display device and a method for driving a display device, wherein the display device comprises a liquid crystal material between a first substrate provided with row electrodes and a second substrate provided with column electrodes, in which overlapping parts of the row and column electrodes define pixels, driving means for driving the column electrodes in conformity with an image to be displayed, and driving means for driving the row electrodes, wherein the row electrodes supply groups of p rows (p>=1) with mutually orthogonal selection signals (Fi) for driving pixels and the image information will be coded in a column voltage, which is supplied to the column electrodes.

The display technique will play an increasingly important role in the information and communication technique in the years to come. Being an interface between humans and the digital world, the display device is of crucial importance for the acceptance of contemporary information systems. Notably portable apparatus such as, for example, notebooks, telephones, digital cameras and personal digital assistants cannot be realized without utilizing displays. The passive matrix LCD technology is a very commonly used display technology; it is used, for example in PDA's and in mobile telephones. Passive matrix displays are usually based on the (S)TN (Super Twisted Nematic) effect. A passive matrix LCD consists of a number of substrates. The display is subdivided in the form of a matrix of rows and columns. The row electrodes and column electrodes are arranged on respective substrates and form a grid. A layer with liquid crystals is provided between said substrates. The intersections of these electrodes form pixels. These electrodes are supplied with voltages that orient the liquid crystal molecules of the driven pixels in an appropriate direction so that the driven pixel appears in a different brightness.

Since the size of the displays becomes larger, the significance of the power consumption of the passive matrix LCDs for mobile applications increases all the time. Because such passive matrix displays are often used in portable apparatus, it is particularly important to realize low power consumption.

In addition to the power consumption, however, the optical performance of such displays is also a decisive criterion for the selection of display devices of this kind. For LCDs it is known to use an addressing technique where a group of p rows is simultaneously driven and the encoded image information is applied to the columns. This MRA (Multiple Row Addressing) technique enables to achieve a very good optical performance in combination with low power consumption. According to said MRA technique a number of p rows are simultaneously driven. A set of orthogonal functions is then applied to the p simultaneously driven rows. A function for the column voltage for driving the corresponding column is calculated from said set of orthogonal functions using a calculation rule. By using this calculation rule for driving the column, a voltage is selected from a plurality of partial column voltage level values, said selected voltage level being applied to the corresponding column so that the corresponding pixels are switched to a state depending on the orthogonal functions and the image data that is supplied from a memory.

In order to drive the whole display, said calculation rule has to be calculated multiple times. This requires intensive data processing and may—dependent on the picture to be displayed—cause the column voltage signal to change very often. This in consequence means that the column driving signal will also have many transitions. The possibly high number of transitions of the column driving signal and the intensive data processing required has a negative impact on the overall power consumption of the driver.

Therefore, it is an object of the present invention to provide a display device and method for driving a passive matrix LCD having low power consumption and attractive optical performance.

This object is solved by the subject of the independent claims.

To this end a display device according to the present invention is provided comprising a liquid crystal material between a first substrate provided with row electrodes and a second substrate provided with column electrodes, in which overlapping parts of the row and column electrodes define pixels, driving means for driving the column electrodes in conformity with an image to be displayed, wherein column voltages Gj(t) are supplyable to the column electrodes, wherein the column voltages Gj(t) to be supplied are selectable from a predetermined number of column voltages levels and driving means for driving the row electrodes, wherein the row electrodes supply groups of p rows (p>=1) with mutually orthogonal selection signals ($F_i$) for driving pixels and the groups of p rows are driven for the duration of a row selection time $p \times n_{frc}$ times during a superframe including $n_{frc}$ frames for generating grey scales, wherein the row selection time is subdivided in $n_{pwm}$ sub selection time slots, and the grey scales are coded in grey scale tables having $n_{frc}$ phases with $n_{pwm}$ sub selection time slots, wherein for the $n_{frc}$ frames of a superframe the grey scales are generated by using phase mixing, defining which phase of grey scale coding is used for a certain frame, wherein a column voltage ($G_j(t)$) is calculated depending on the grey scales to be displayed by the p concurrently driven pixels in a column and depending on the used mutually orthogonal selection signals ($F_i$) for the corresponding group of rows, wherein a change in the column voltage level is defining a transition and wherein the column voltage ($G_j(t)$) to be supplied to a column electrode (6) has always less transitions per row selection time than the number $n_{pwm}$ of sub selection time slots of the row selection time.

In the following the individual methods used for driving a display device according to the present invention are described.

Display cells based on the STN (Super-Twisted Nematic) effect generally have a very steep transmission voltage characteristic, which makes it difficult to realize grey scales. One method for generating grey scales is a method called "frame rate control" (FRC) which is a technique to generate different grey scales by varying the state of a pixel between ON and OFF within a certain number of consecutive frames. A certain number of $n_{frc}$ consecutive frames define a superframe. In this respect a single frame period is the period in which all rows are selected p times each, be it singularly (Alt & Pleshko) or in groups (MRA). Because of the persistency of the human vision system and the properties of the liquid crystal, the different states are averaged and perceived as one grey scale. Disadvantageous is the problem of flickering, which appears, when grey scales in adjacent pixels are generated with the same sequence at a too low frame frequency.

Another technique for displaying grey scales is called Pulse Width Modulation (PWM). For PWM the row selection time is subdivided in $n_{pwm}$ sub selection time slots. Therewith and by driving the column signal during each of these different sub selection time slots to an individual level, a maximum of $n_{pwm}+1$ different grey scales can be generated.

By combining frame rate control (FRC) e.g. with $n_{frc}$=4 frames and PWM with e.g. $n_{pwm}$=4 sub selection time slots, 17 grey scales can be generated. However, by doing so the column voltage $G_j(t)$ has to be calculated in this example four times for one column per row selection time. The grey scales are coded in grey scale tables which are stored in the column driving means.

In the following the structure of a grey scale table will be described. A grey scale table defines the pixel state $a_{i,j}$ for a certain sub selection time slot for all the combinations of sub selection time slots, frame/phases, and grey scales. I.e. in Table 1 the pixel state $a_{i,j}$ for grey scale GS 5 is defined as follows: in the first frame/phase the pixel state is always 1, in the second frame/phase the pixel state is only in the first sub selection time slot 1, for the three subsequent sub selection time slots of that frame/phase and the following frames/phases the pixel state is always 0. This means that a grey scale on a certain pixel is achieved by providing different pixel states over the number of frames/phases and sub selection time slots, whereby the change of the order of pixel states over the frames belonging to one and the same superframe does not influence the resulting and displayed grey scale on that certain pixel.

Table 1 shows a realisation of a grey scale table for the example with 4 frames/phases, whereby the row selection time is subdivided into four row sub selection time slots.

TABLE 1

| | | Frame/Phase and sub selection time slot | | | | | | | | | | | | | | | |
|---|---|---|---|---|---|---|---|---|---|---|---|---|---|---|---|---|---|
| | | Frame/Phase 0 | | | | Frame/Phase 1 | | | | Frame/Phase 2 | | | | Frame/Phase 3 | | | |
| | | 0 | 1 | 2 | 3 | 0 | 1 | 2 | 3 | 0 | 1 | 2 | 3 | 0 | 1 | 2 | 3 |
| Grey scale | 0 | 0 | 0 | 0 | 0 | 0 | 0 | 0 | 0 | 0 | 0 | 0 | 0 | 0 | 0 | 0 | 0 |
| | 1 | 1 | 0 | 0 | 0 | 0 | 0 | 0 | 0 | 0 | 0 | 0 | 0 | 0 | 0 | 0 | 0 |
| | 2 | 1 | 1 | 0 | 0 | 0 | 0 | 0 | 0 | 0 | 0 | 0 | 0 | 0 | 0 | 0 | 0 |
| | 3 | 1 | 1 | 1 | 0 | 0 | 0 | 0 | 0 | 0 | 0 | 0 | 0 | 0 | 0 | 0 | 0 |
| | 4 | 1 | 1 | 1 | 1 | 0 | 0 | 0 | 0 | 0 | 0 | 0 | 0 | 0 | 0 | 0 | 0 |
| | 5 | 1 | 1 | 1 | 1 | 1 | 0 | 0 | 0 | 0 | 0 | 0 | 0 | 0 | 0 | 0 | 0 |
| | 6 | 1 | 1 | 1 | 1 | 1 | 1 | 0 | 0 | 0 | 0 | 0 | 0 | 0 | 0 | 0 | 0 |
| | 7 | 1 | 1 | 1 | 1 | 1 | 1 | 1 | 0 | 0 | 0 | 0 | 0 | 0 | 0 | 0 | 0 |
| | 8 | 1 | 1 | 1 | 1 | 1 | 1 | 1 | 1 | 0 | 0 | 0 | 0 | 0 | 0 | 0 | 0 |
| | 9 | 1 | 1 | 1 | 1 | 1 | 1 | 1 | 1 | 1 | 0 | 0 | 0 | 0 | 0 | 0 | 0 |
| | 10 | 1 | 1 | 1 | 1 | 1 | 1 | 1 | 1 | 1 | 1 | 0 | 0 | 0 | 0 | 0 | 0 |
| | 11 | 1 | 1 | 1 | 1 | 1 | 1 | 1 | 1 | 1 | 1 | 1 | 0 | 0 | 0 | 0 | 0 |
| | 12 | 1 | 1 | 1 | 1 | 1 | 1 | 1 | 1 | 1 | 1 | 1 | 1 | 0 | 0 | 0 | 0 |
| | 13 | 1 | 1 | 1 | 1 | 1 | 1 | 1 | 1 | 1 | 1 | 1 | 1 | 1 | 0 | 0 | 0 |
| | 14 | 1 | 1 | 1 | 1 | 1 | 1 | 1 | 1 | 1 | 1 | 1 | 1 | 1 | 1 | 0 | 0 |
| | 15 | 1 | 1 | 1 | 1 | 1 | 1 | 1 | 1 | 1 | 1 | 1 | 1 | 1 | 1 | 1 | 0 |
| | 16 | 1 | 1 | 1 | 1 | 1 | 1 | 1 | 1 | 1 | 1 | 1 | 1 | 1 | 1 | 1 | 1 |

To solve the problem of flickering and high frame frequency a technique is used called phase mixing. In order to prevent visible artifacts like flickering especially at low frame frequencies it is necessary that grey scales in adjacent pixels are generated with a different pattern or sequence of pixels states. For generating a different pattern for adjacent pixels this phase mixing method is applied. Phase mixing uses a set of tables, which are denoted as phase mixing tables that assign each pixel and frame a certain phase such that the phase of a particular pixel changes from frame to frame without having twice the same value. For each phase and grey scale the grey scale table then defines the pixel state to sub selection time slot assignment to be used. By assigning adjacent pixels in the same frame to different phases, the pattern for generating grey scales can be altered. So by using phase mixing it is achieved that grey scales in adjacent pixels over a sequence of frames are generated with a different pattern. The phase which is used for a certain pixel increases by one for the following frame. Also other rules for changing the phase between frames may be used provided that for any pixel each phase is only used once within a superframe. Phase mixing can also be used for FRC only, hence without the combination with PWM.

Table 2 shows one set of possible phase mixing tables. In the example in Table 2 a so called 4×4 mixing is used. This means that phase mixing is done within squares of 4 by 4 pixels. Furthermore, the phase mixing tables in Table 2 follow the rule that from frame to frame the phases are incremented by one.

TABLE 2

| Frame 0 | | | | |
|---|---|---|---|---|
| | Col | | | |
| ROW | 0 | 1 | 2 | 3 |
| 0 | 0 | 2 | 1 | 3 |
| 1 | 1 | 3 | 2 | 0 |
| 2 | 2 | 1 | 0 | 3 |
| 3 | 3 | 0 | 2 | 1 |

TABLE 2-continued

| Frame 1 | | | | |
|---|---|---|---|---|
| | Col | | | |
| ROW | 0 | 1 | 2 | 3 |
| 0 | 1 | 3 | 2 | 0 |
| 1 | 2 | 0 | 3 | 1 |
| 2 | 3 | 2 | 1 | 0 |
| 3 | 0 | 1 | 3 | 2 |

TABLE 2-continued

| Frame 2 | | | | |
|---|---|---|---|---|
| | Col | | | |
| ROW | 0 | 1 | 2 | 3 |
| 0 | 2 | 0 | 3 | 1 |
| 1 | 3 | 1 | 0 | 2 |
| 2 | 0 | 3 | 2 | 1 |
| 3 | 1 | 2 | 0 | 3 |
| **Frame 3** | | | | |
| | Col | | | |
| ROW | 0 | 1 | 2 | 3 |
| 0 | 3 | 1 | 0 | 2 |
| 1 | 0 | 2 | 1 | 3 |
| 2 | 1 | 0 | 3 | 2 |
| 3 | 2 | 3 | 1 | 0 |

The phase mixing tables in Table 2 define that e.g. during frame 0 the pixel $p_{0,1}$ (row index 0, column index 1) will be generated according to phase 2. Referring back to Table 1, this means that pixel $p_{0,1}$ will be driven based on the pixel states as specified in Table 1 for frame/phase 2. What this exactly means, will be explained now in more detail with an example: Given that pixel $p_{0,1}$ should be displayed with grey scale 5, and provided that the grey scale Table 1 and the phase mixing Table 2 are used, pixel $p_{0,1}$ will be driven in frame 0 according to phase 2. This means that pixel $p_{0,1}$ is driven in frame 0 four times with a pixel state of 0. In the next frame that is frame 1, pixel $p_{0,1}$ will be driven according to phase 3 and therefore with four times a pixel state of 0. In frame 2 pixel $p_{0,1}$ will be driven according to phase 0 and therefore with four times a pixel state of 1. Finally, in the last frame that is frame 3, pixel $p_{0,1}$ will be driven according to phase 1 and therefore with a pixel state of once 1 and then three times 0. Comparing this to pixel $p_{0,2}$ which is the next column neighbor to pixel $p_{0,1}$, it can be seen from Table 2 that this pixel is driven in all frames with phases differing from the ones of pixel $p_{0,1}$. Therewith and provided that pixel $p_{0,2}$ is also meant to be driven to grey scale 5, the pattern how the grey scales are generated will differ. As a consequence, flickering foremost at low frame frequencies can be reduced considerably.

The column voltage G(t) for the duration a certain group of p rows selected (row selection time) is calculated by using the equation or calculation rule below, wherein the column voltage G(t) depends on the pixel states $a_{i,j}$ to be displayed in the respective column for the group of rows selected and on the set of orthogonal selection signals which are supplied to the p rows of the group, $$G_j(t) = \frac{1}{\sqrt{N}}\{a_{0,j} * F_0(t) + a_{i,j} * F_1(t) + a_{2,j} * F_2(t) + a_{3,j} * F_3(t)\} \quad (1)$$

whereas Eq. (1) represents the column driving voltage ($G_j$(t)-function) for MRA with p=4 for the column with index j for the duration a certain group of p rows is selected and under the assumption that the row index i is given as the row number modulo 4. Note: $a_{i,j}$: pixel state of the pixel given by $row_i$ and $column_j$ (pixel in its ON state: $a_{i,j}$=−1 dec (chosen to be represented by 0 digital), pixel in its OFF state: $a_{i,j}$=+1 dec (chosen to be represented by 1 digital)).

$F_i$(t): orthogonal function applied to $row_i$ (possible normalized values in case of the walking −1 set of orthogonal functions are: −1 dec (chosen to be represented by 0 digital), +1 dec (chosen to be represented by 1 digital).

Gj(t): column function to be applied to $column_j$ for the duration the respective group of p rows is selected.

N: number of rows of the display.

Since in Table 1 in all frames/phases from 0 to 3 grey scales exist for which not all sub selection time slots of the respective phase are equally driven, the column driving voltage $G_j$(t) and therewith Eq. (1) needs to be calculated at most four times per row selection time.

This calculation will be illustrated now with an example:

Given is that pixel $p_{0,0}$ should be displayed with grey scale 1, pixel $p_{1,0}$ with grey scale 6, pixel $p_{2,0}$ with grey scale 11, and pixel $p_{3,0}$ with grey scale 16 and provided is that the grey scale table 1 and the phase mixing table 2 are used.

From Table 2 it can be derived that for frame 0 pixel $p_{0,0}$ has to be driven according to phase 0, pixel $p_{1,0}$ according to phase 1, pixel $p_{2,0}$ according to phase 2, and pixel $p_{3,0}$ according to phase 3.

From Table 1 it can be derived that pixel $p_{0,0}$ for phase 0 and for grey scale 1 has to be driven over the four row sub selection time slots with the pixel state sequence $a_{0,0}$={1, 0, 0, 0}. Pixel $p_{1,0}$ for phase 1 and grey scale 6 with the pixel state sequence $a_{1,0}$={1, 1, 0, 0}. Pixel $p_{2,0}$ for phase 2 and grey scale 11 with the pixel state sequence $a_{2,0}$={1, 1, 1, 0} and pixel $p_{3,0}$ for phase 3 and grey scale 16 with the pixel state sequence $a_{3,0}$={1 ,1, 1, 1}.

Substituting in Eq. (1) in a first step $a_{0,0}$, $a_{1,0}$, $a_{2,0}$, and $a_{3,0}$ by the first elements of the respective pixel state sequence and in a second step by the second elements of the respective sequence and so on, reveals that none of the resulting equations end up to look the same. As a consequence, Eq. (1) and therewith $G_j$(t) needs to be calculated in this example four times.

The fact that Eq. (1) needs to be calculated at most four times per row selection time implies that the pixel data of all four pixels needs either to be read four times from a RAM or needs to be latched after its first readout. This under the assumption that the pixel data is buffered in an on-chip RAM prior to being processed. The first solution increases the power consumption whilst the latter solution requires additional chip area in order to latch the data.

But the fact that Eq. (1) needs to be calculated at most four times per row selection time implies also that the column driving voltage may take within one and the same row selection time as many as four different column voltage levels. As a matter of fact, at most four transitions per row selection time may occur. Unfortunately, the number of transitions per row selection time has a direct impact on the power consumption.

The inventive arrangement and method of the present invention is characterized by the grey scale table and phase mixing tables as specified hereafter.

By using a grey scale table having for all grey scales code parts with a change within a frame/phase concentrated in one phase, the so called PWM-Phase, and by using a special phase mixing table, it is achieved that the number of transitions of the column voltage per row selection time and therewith the number of times the column voltage has to be calculated per row selection time is minimized.

TABLE 3

| | | Frame/Phase and sub slot | | | | | | | | | | | | | | | |
|---|---|---|---|---|---|---|---|---|---|---|---|---|---|---|---|---|---|
| | | Frame/Phase 0 | | | | Frame/Phase 1 | | | | Frame/Phase 2 | | | | Frame/Phase 3 | | | |
| | | 0 | 1 | 2 | 3 | 0 | 1 | 2 | 3 | 0 | 1 | 2 | 3 | 0 | 1 | 2 | 3 |
| Grey scale | 0 | 0 | 0 | 0 | 0 | 0 | 0 | 0 | 0 | 0 | 0 | 0 | 0 | 0 | 0 | 0 | 0 |
| | 1 | 0 | 0 | 0 | 0 | 0 | 0 | 0 | 0 | 0 | 0 | 0 | 0 | 1 | 0 | 0 | 0 |
| | 2 | 0 | 0 | 0 | 0 | 0 | 0 | 0 | 0 | 0 | 0 | 0 | 0 | 1 | 1 | 0 | 0 |
| | 3 | 0 | 0 | 0 | 0 | 0 | 0 | 0 | 0 | 0 | 0 | 0 | 0 | 1 | 1 | 1 | 0 |
| | 4 | 1 | 1 | 1 | 1 | 0 | 0 | 0 | 0 | 0 | 0 | 0 | 0 | 0 | 0 | 0 | 0 |
| | 5 | 1 | 1 | 1 | 1 | 0 | 0 | 0 | 0 | 0 | 0 | 0 | 0 | 1 | 0 | 0 | 0 |
| | 6 | 1 | 1 | 1 | 1 | 0 | 0 | 0 | 0 | 0 | 0 | 0 | 0 | 1 | 1 | 0 | 0 |
| | 7 | 1 | 1 | 1 | 1 | 0 | 0 | 0 | 0 | 0 | 0 | 0 | 0 | 1 | 1 | 1 | 0 |
| | 8 | 1 | 1 | 1 | 1 | 1 | 1 | 1 | 1 | 0 | 0 | 0 | 0 | 0 | 0 | 0 | 0 |
| | 9 | 1 | 1 | 1 | 1 | 1 | 1 | 1 | 1 | 0 | 0 | 0 | 0 | 1 | 0 | 0 | 0 |
| | 10 | 1 | 1 | 1 | 1 | 1 | 1 | 1 | 1 | 0 | 0 | 0 | 0 | 1 | 1 | 0 | 0 |
| | 11 | 1 | 1 | 1 | 1 | 1 | 1 | 1 | 1 | 0 | 0 | 0 | 0 | 1 | 1 | 1 | 0 |
| | 12 | 1 | 1 | 1 | 1 | 1 | 1 | 1 | 1 | 1 | 1 | 1 | 1 | 0 | 0 | 0 | 0 |
| | 13 | 1 | 1 | 1 | 1 | 1 | 1 | 1 | 1 | 1 | 1 | 1 | 1 | 1 | 0 | 0 | 0 |
| | 14 | 1 | 1 | 1 | 1 | 1 | 1 | 1 | 1 | 1 | 1 | 1 | 1 | 1 | 1 | 0 | 0 |
| | 15 | 1 | 1 | 1 | 1 | 1 | 1 | 1 | 1 | 1 | 1 | 1 | 1 | 1 | 1 | 1 | 0 |
| | 16 | 1 | 1 | 1 | 1 | 1 | 1 | 1 | 1 | 1 | 1 | 1 | 1 | 1 | 1 | 1 | 1 |

Table 3 shows a grey scale table according to the invention with rearranged sub selection time slots. In Table 3, all grey scale code parts of any grey scale for which not all sub selection time slots are equally driven, are concentrated in one frame/phase (phase 3). This phase is called PWM-phase. In the remaining phases, phase 0, 1 and 2, all four sub selection time slots are equally driven. In order to fully benefit from that inventive grey scale table 3, the phase mixing scheme from Table 2 had to be adapted such that in Eq. (1) only one of the four products depends on a PWM-phase (phase 3 in Table 3). This corresponds to the requirement that no column in the phase mixing table may have more than one PWM-phase (phase 3). All the remaining phases 0, 1 and 2 depend on FRC-phases only, which are characterized by having no change in the grey scale code within a frame/phase. FRC-phases therefore do not force a transition in the column driving signal. Since grey scales 0, 4, 8, 12 and 16 do not have code parts with changes within a frame/phase, there is no PWM processing for these grey scales required.

In Table 4 an example of a phase mixing table that fulfils the requirement of having only one PWM-phase (phase 3) per column in any frame is shown.

TABLE 4

| Frame 0 | | | | |
|---|---|---|---|---|
| | Col | | | |
| ROW | 0 | 1 | 2 | 3 |
| 0 | 0 | 2 | 1 | 3 |
| 1 | 2 | 0 | 3 | 1 |
| 2 | 1 | 3 | 0 | 2 |
| 3 | 3 | 1 | 2 | 0 |
| **Frame 1** | | | | |
| | Col | | | |
| ROW | 0 | 1 | 2 | 3 |
| 0 | 1 | 3 | 2 | 0 |
| 1 | 3 | 1 | 0 | 2 |
| 2 | 2 | 0 | 1 | 3 |
| 3 | 0 | 2 | 3 | 1 |

TABLE 4-continued

| Frame 2 | | | | |
|---|---|---|---|---|
| | Col | | | |
| ROW | 0 | 1 | 2 | 3 |
| 0 | 2 | 0 | 3 | 1 |
| 1 | 0 | 2 | 1 | 3 |
| 2 | 3 | 1 | 2 | 0 |
| 3 | 1 | 3 | 0 | 2 |
| **Frame 3** | | | | |
| | Col | | | |
| ROW | 0 | 1 | 2 | 3 |
| 0 | 3 | 1 | 0 | 2 |
| 1 | 1 | 3 | 2 | 0 |
| 2 | 0 | 2 | 3 | 1 |
| 3 | 2 | 0 | 1 | 3 |

Since Table 4 is only one example for a suitable phase mixing scheme, Table 5 illustrates other possibilities how the PWM-phase (phase 3) can be arranged, according to the invention.

TABLE 5

| Frame 0, 1, 2 or 3 | | | | |
|---|---|---|---|---|
| | RGB-Col | | | |
| ROW | 0 | 1 | 2 | 3 |
| 0 | x | x | x | 3 |
| 1 | x | x | 3 | x |
| 2 | x | 3 | x | x |
| 3 | 3 | x | x | x |
| **Frame 0, 1, 2 or 3** | | | | |
| | RGB-Col | | | |
| ROW | 0 | 1 | 2 | 3 |
| 0 | 3 | x | x | x |
| 1 | x | x | 3 | x |

TABLE 5-continued

| | | | | |
|---|---|---|---|---|
| 2 | x | 3 | x | x |
| 3 | x | x | x | 3 |
| | Frame 0, 1, 2 or 3 | | | |
| | RGB-Col | | | |
| ROW | 0 | 1 | 2 | 3 |
| 0 | 3 | x | x | x |
| 1 | x | x | 3 | x |
| 2 | x | x | x | 3 |
| 3 | x | 3 | x | x |
| | Frame 0, 1, 2 or 3 | | | |
| | RGB-Col | | | |
| ROW | 0 | 1 | 2 | 3 |
| 0 | 3 | 3 | 3 | 3 |
| 1 | x | x | x | x |
| 2 | x | x | x | x |
| 3 | x | x | x | x |

The phase mixing schemes shown in Table 5 are suitable examples for phase mixing schemes for the invention, under the condition of the grey scale table 3, wherein for all grey scales code parts with a change within a frame/phase are concentrated in the PWM-phase 3. An x in the phase mixing scheme means that the phase being used could be any, but not a PWM-phase 3 and preferably not a phase already used in the same column.

When now performing phase mixing as illustrated in Table 5, the phase for which pulse width modulation is required (phase 3) appears only once per column. In respect to the equation Eq. (1) by which the column voltage function $G_j(t)$ for MRA with p=4 is generated, it can be concluded that only one product needs to be recalculated once within a row selection time, namely the product whose pixel state depends on pulse width modulation. All other products remain the same for the entire row selection time—as for pure frame rate control—since for these products neither the pixel state nor the orthogonal function changes within that particular row selection time.

Also in the case of the product that needs to be recalculated only once within a row selection time, the row orthogonal function $F_i(t)$ is the same for all four row sub selection time slots. As a consequence, the product depends only on the pixel state and this is either one or zero (digital). Hence, the result of the product can only have two possible values that differ by exactly 1 dec. As a consequence, also the result of the column voltage $G_j(t)$ takes only two different values per row selection time again differing only by 1 dec. As a matter of fact the column voltage $G_j(t)$ takes at most two different levels during one and the same row selection time. Furthermore, when recalling Table 3 it can be easily seen that the row sub selection time slots within a frame/phase for which the pixel state is one and the row sub selection time slots for which the pixel state is zero are always grouped together. As a consequence, the column voltage $G_j(t)$ not only takes no more than two different column voltage levels but it also has no more than one transition during a row selection time.

In the case of p=4 and $n_{frc}$=4 for example, the number of transitions in the column voltage during a row selection time can be reduced to at most one. Moreover, it is achieved that whenever a transition within a row selection time occurs this is only a transition to the next adjacent column voltage level.

In the case of p=8 and $n_{frc}$=4 as a second example, the number of transitions in the column voltage during a row selection time can be reduced to at most two. Furthermore, it is achieved that for the maximum of two transitions within a row selection time, both transitions are only to the next adjacent level, whereas for one single transition within a row selection time, the transition is always only to the over-next column voltage level.

Moreover, the fact that the present invention minimizes the number of transitions per row selection time implies that also the number of times Eq. (1) needs to be calculated per row selection time is minimized.

For example in the case of p=4 and $n_{frc}$=4, with the maximum number of transitions during a row selection time being one, the number of possible column voltage levels per row selection time results in at most two. Therewith, the number of times Eq. (1) needs to be calculated per row selection time is also at most two. However, when taking into account that the two column voltage levels differ at most by one level, it is sufficient to calculate Eq. (1) only once and then to increment or decrement the column level by one level at the right point in time.

In the case of p=8 and $n_{frc}$=4 as a second example, with the maximum number of transitions during a row selection time being two, the number of possible column voltage levels per row selection time results in at most three. Therewith, the number of times Eq. (1) needs to be calculated per row selection time is also at most three. However, when taking into account that the three levels differ from the always previous one at most by one level, it is sufficient to calculate Eq. (1) only once and then to increment or decrement the column level at the right point in time by always one level. Given that both transitions are meant to take place at the same point in time, only one transition however this time by two levels will be the result. Consequently, the column voltage level has to be incremented or decremented by two instead of one.

Finally, it is a characteristic of the present invention that the number of transitions remains constant even when increasing the number of grey scales in the grey scale table, provided that the inventive arrangement and method is used.

In above example with p=4 and $n_{frc}$=4 it was found that it is sufficient to calculate $G_j(t)$ exactly once—either based on a PWM-pixel state of zero or a PWM-pixel state of one—and then to increment or decrement the result respectively by one at the right point in time. In direct consequence this means that the pixel data of a certain pixel has only to be read once from the RAM. Either the pixel data of all four pixels, in case of p=4, is read in parallel—that makes sense for a parallel calculation of the four products—or the pixel data of each of the four pixels is read serially—that makes sense for a sequential calculation of the four products. The latter solution has the advantage of requiring less area since the bus width of the data bus from the RAM to the column blocks ends up to be four times smaller than in the parallel readout case.

The new grey scale generation technique combining frame rate control with Pulse width modulation retains the benefit of a good optical performance at a low frame frequency and therewith the positive impact on the overall power consumption of the driver. In contrast to the state of the art, the requirement for only moderate data processing further affects the power consumption positively. Moreover, the low number of RAM readouts without the need for additional latches and the low number of transitions in the column driving signal per row selection time additionally helps to keep the power consumption low.

The present invention allows reducing the data-processing as well as the number of transitions of the column driving signal per row selection time. Moreover, the transition within the row selection time is just a transition to the next adjacent level. As a consequence the power consumption and dependent on the implementation even the chip area requirements can be reduced considerably.

The display arrangement and method is applicable for any driving scheme that combines MRA with Frame rate control (FRC) and pulse width modulation (PWM) as long as the number of frames $n_{frc}$ used to generate the grey scales is equal or larger than the number of concurrently selected rows p of the MRA driving scheme. Thereby this method can also be used for AP (Alt & Pleshko) driving scheme. Furthermore, this method can be used for 4 k color generation as well as for 64 k color generation as well as for others.

It allows by carefully optimizing the pattern in the grey scale table how the different grey scales are generated to reduce the data processing required and to decrease the number of transitions of the column driving signal per row selection time. As a result, the power consumption of the driver can be reduced considerably.

In a further embodiment of the invention a display device is provided, wherein a mirroring of the column voltage waveform is performed by calculating the column voltage for the subsequent row selection time during the current row selection time and the column voltage waveform is mirrored on a mirror axis in the middle of a row selection time. This mirroring is performed adaptively only when the column voltage at the end of the current row selection time is the same as the column voltage at the end of the following row selection time. By this a further reduction of transitions can be achieved, resulting in a further reduction of the power consumption.

These and other aspects of the invention will be apparent from and elucidated with reference to the embodiment(s) described hereinafter.

For a more complete description of the present invention and for further objects and advantages thereof, reference is made to the following description, taken in conjunction with the accompanying drawings, in which:

FIG. 5 shows a further possible grey scale table according to the present invention;

Figure 7:
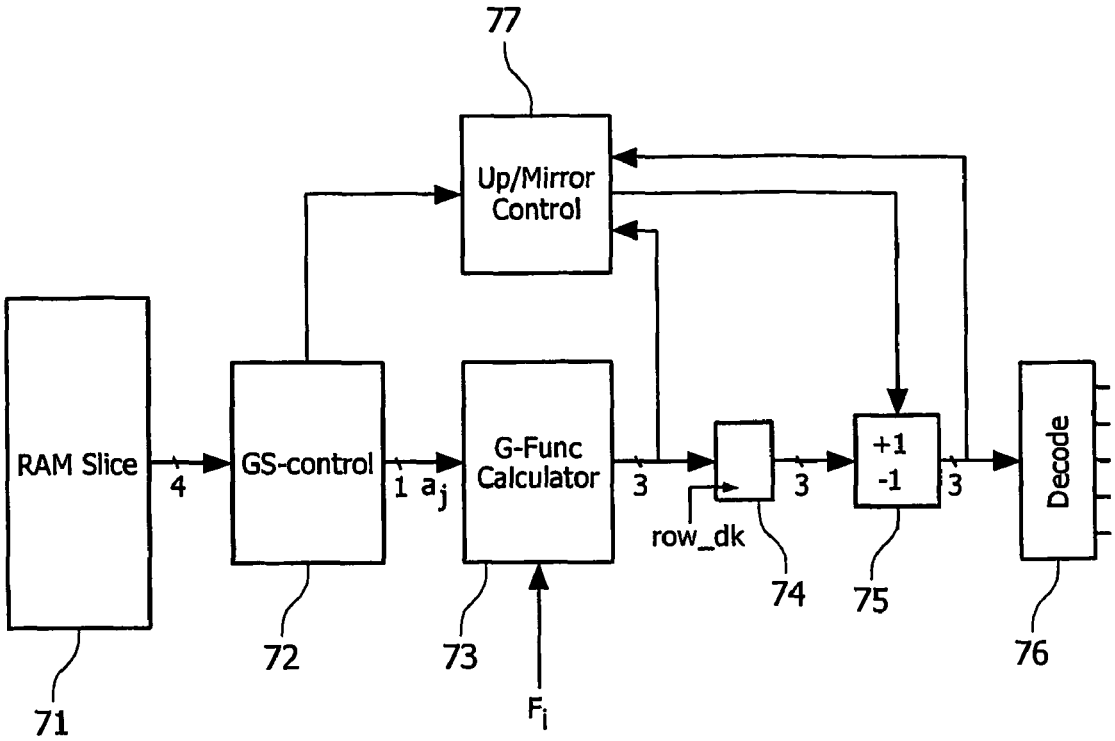

FIG. 6*a, b* illustrate the mirroring of the column voltage waveforms;

FIG. 7 shows a block diagram for column voltage level generation

Figure 1:
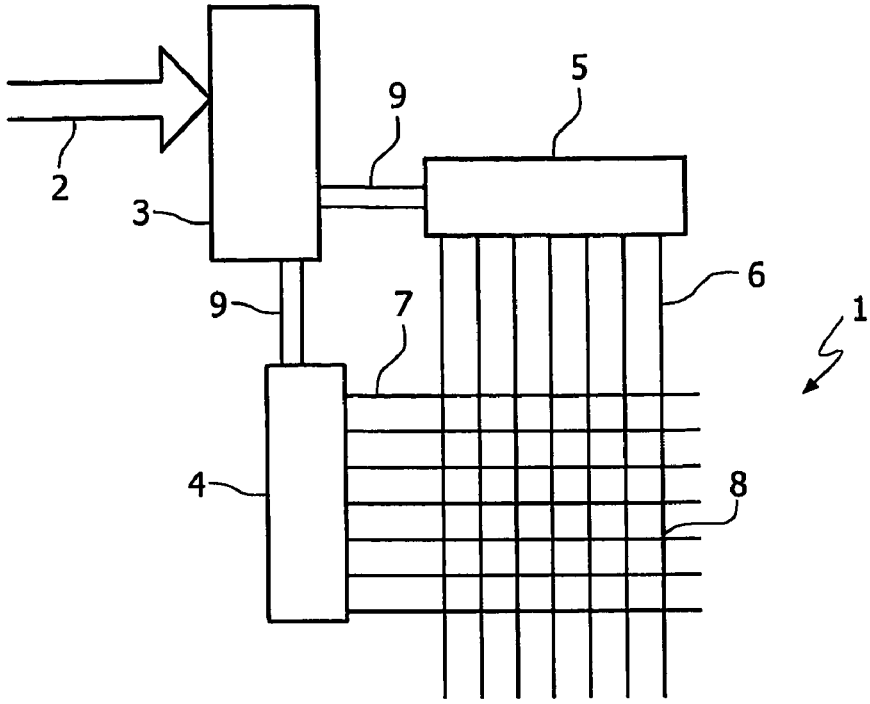
FIG. 1 shows an electric equivalent circuit diagram of a part of a display device according to the present invention.

FIG. 1 shows an electric circuit diagram of a part of a display device 1 to which the invention is applicable. It comprises a matrix of pixels 8 defined by the areas of crossings of row or selection electrodes 7 and column or data electrodes 6. The row electrodes 7, in one mode of driving, are consecutively selected by means of a row driver 4, while the column electrodes 6 are provided with data via a data register 5. To this end, incoming data 2 are first processed, if necessary, in a processor 3. Mutual synchronization between the row driver 4 and the data register 5 takes place via drive lines 9.

Figure 2:
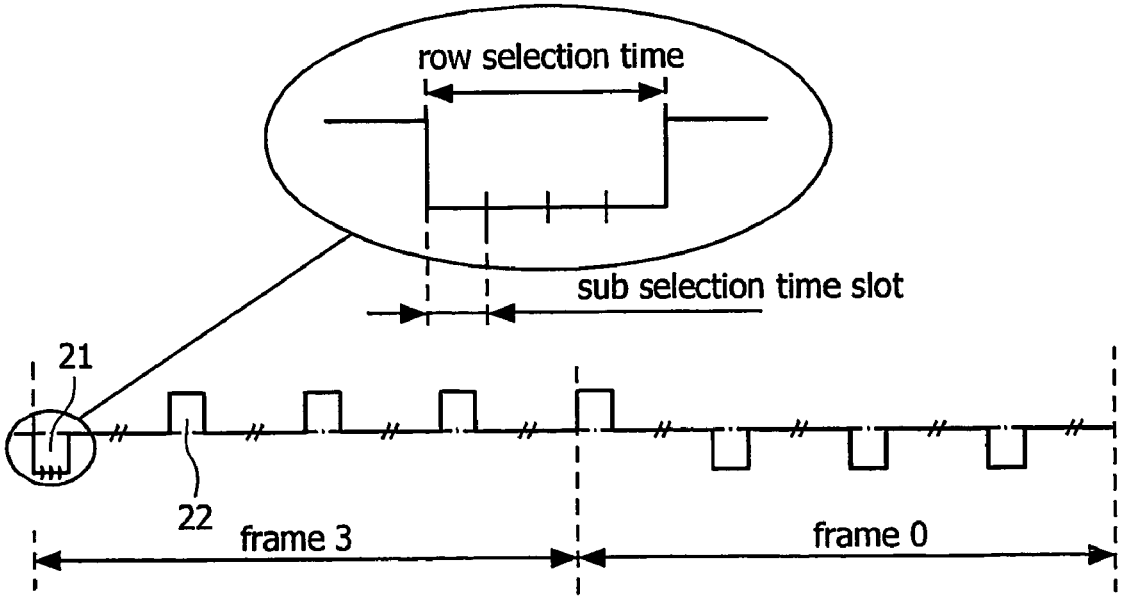
FIG. 2 shows row selection pulses for MRA with p=4 and a splitting of one row selection pulse into four sub selection time slots

FIG. 2 shows a sequence of row selection pulses in two subsequent frames 3 and 0 for one row. The example shown in FIG. 2 is based on MRA with p=4 concurrently driven rows, frame rate control (FRC) with $n_{frc}$=4 frames and PWM with $n_{pwm}$ sub selection time slots. The pulse 21 provided during the first row selection time to e.g. row 0—the first of the row electrodes 7—is part of the row selection function $F_0(t)$ which is in this example defined by the sequence $\{-1, 1, 1, 1\}$. At the same time, the p−1 neighbouring rows—in this case rows (1-3)—are selected by pulses similar to the one of row 0. The pulses of the neighbouring rows are defined by row selection functions $F_i(t)$ which are orthogonal to $F_0(t)$. After that and during the next row selection time, the next group of p rows—in this case rows (4-7)—are selected in the same way. After all rows of the display are selected once, the selection process restarts from the beginning, this time with pulse 22 of frame 3 as row selection pulse for the first row and with selection pulses according to their respective row selection functions in the neighbouring p−1 rows.

Figure 3:
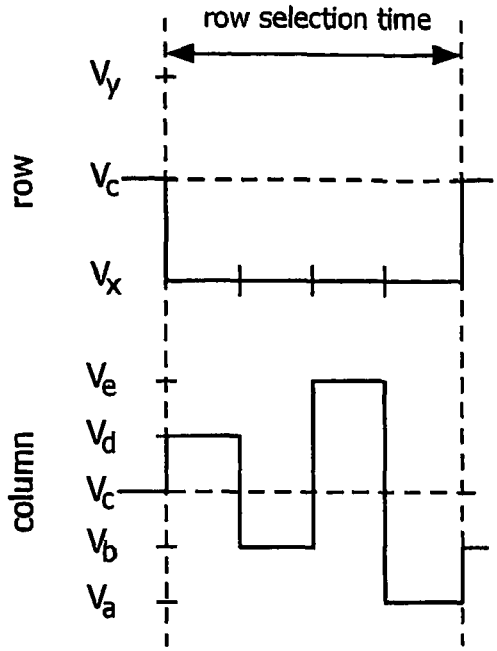
FIG. 3 shows possible column voltage levels during one row selection time for p=4 and $n_{pwm}$=4 according to the prior art.

FIG. 3 shows the column voltage levels which could be supplied according to the prior art to a column electrode 6 for the sample case of MRA with p 4 and PWM with $n_{pwm}$=4. During a row selection time the row selection voltage $V_x$ or $V_y$ is supplied to the row electrode 7, depending on the orthogonal function $F_i(t)$ to be used. Further at most five different column voltage levels ($V_a$, $V_b$, $V_c$, $V_d$, $V_e$) could appear since in all phases grey scales exist for which not all sub selection time slots are equally driven, so the column voltage $G_j(t)$ and therefore the Eq. (1) has to be calculated four times per row selection time.

Figure 4:
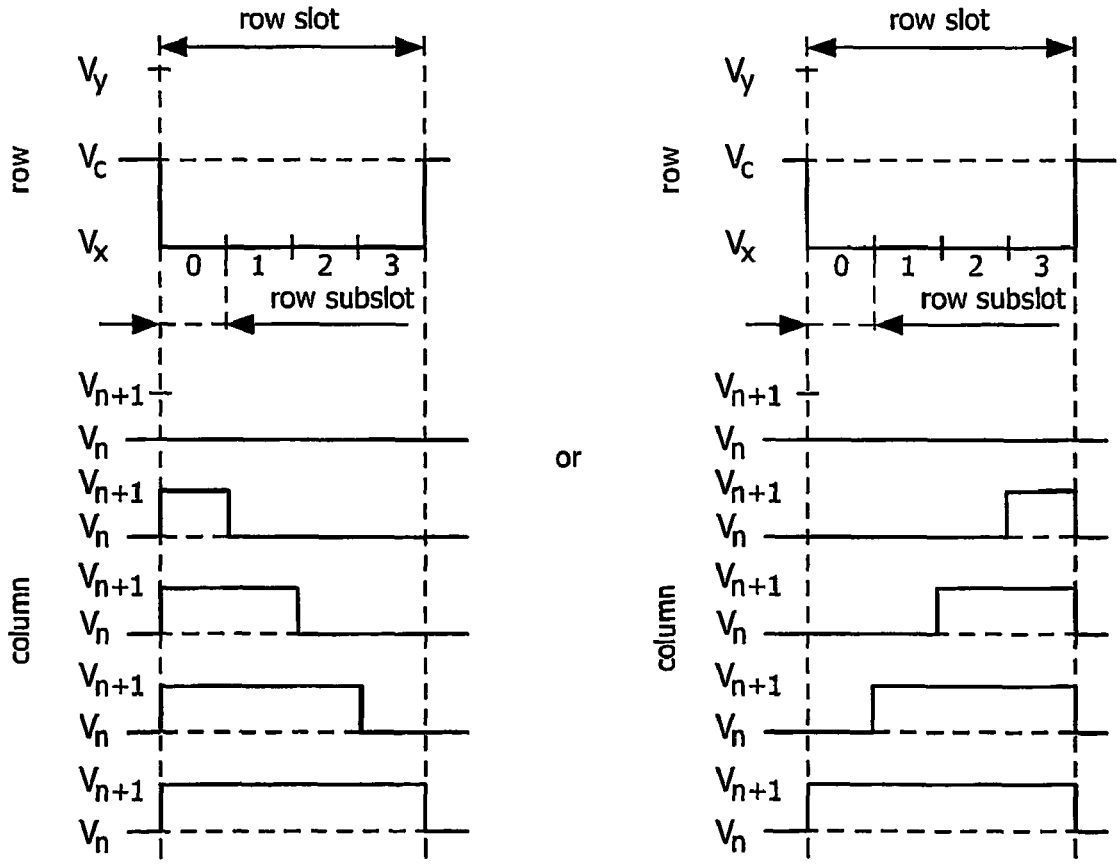
FIG. 4 shows possible column waveforms during a row selection time for p=4, $n_{frc}$=4 and $n_{pwm}$=4 according to the present invention

In contrast to FIG. 3, which shows the column voltage levels according to the prior art, FIG. 4 illustrates the possible column voltage waveforms for p=4, $n_{frc}$=4 and $n_{pwm}$=4 according to the invention. In FIG. 4 the voltage levels $V_n$ and $V_{n+1}$ stand for any two subsequent voltage levels out of the five possible ones $V_a$, $V_b$, $V_c$, $V_d$, $V_e$ from FIG. 3. By using the grey scale table from Table 3 or FIG. 5 and by further using the phase mixing scheme of Table 4 or one out of Table 5, it is sufficient to calculate the $G_j(t)$-function for driving the column exactly once for one row selection time. Because of the inventive alignment of the logical codes in the grey scale table which is characterized by the concentration of all grey scale code parts having a change within a phase in the PWM-Phase (phase 3) and by the inventive organization of the phase mixing table which is characterized by the appearance of only one PWM-Phase (phase 3) in any column of the phase mixing table, at most one transition appears in the column driving voltage during a row selection time. Furthermore, in the case of a transition it is only a transition to the next lower or next higher column voltage level. Thereby, the next lower level can be generated by decrementing the initial column voltage level by one level, whereas the next higher level can be generated by incrementing the initial column voltage level by one level respectively. This is illustrated in FIG. 4 for the case of a transition to the next lower column voltage level by the waveforms having a transition from $V_{n+1}$ to $V_n$ and for the case of transition to the next higher voltage level by the waveforms having a transition from $V_n$ to $V_{n+1}$. As a result of this inventive method, the processing effort as well as the number of transitions per row selection time is minimized.

FIG. 5 shows an alternative grey scale table according to the invention. The grey scale codes parts having a changes within a phase/frame are concentrated in the PWM-Phase (phase 3). The remaining phases 0, 1 and 2 include only grey scale code parts for which all row sub selection time slots are equally driven. In respect to Table 3 the grey scale table of FIG. 5 provides a better optical performance and allows for a lower frame frequency.

FIG. 6*a, b* show an additional possibility to save power by further reducing the number of transitions. This further reducing of transitions is achieved by mirroring the column voltage waveform on a mirror axis. In FIG. 6*a* the column voltage waveform is presented according to the invention, but without the mirroring. The whole sequence of this column voltage signal includes 5 transitions. In FIG. 6*b* a column voltage waveform is provided, which is mirrored on the mirror axis, so the transition between row selection time n and row selection time n+1 is saved. By doing this mirroring consequently along the whole column voltage which is provided to a certain column, a large number of transitions can be saved. Therewith, the power consumption will be further reduced.

FIG. 7 shows a block diagram for generating the column voltages, which are provided to the column electrodes. The Block 71 shows a part of memory RAM. This RAM Slice 71 stores the pixel data for one column of the display. The pixel data for that column is supplied to the grey scale control block 72. The grey scale control block 72 stores the grey scale table and the phase mixing tables as for example depicted in Table 3 and FIG. 5. Based on these tables and the pixel data from the RAM Slice 71, the pixel state $a_{i,j}$ (ON or OFF) of a certain pixel during a certain row sub selection time slot is derived. Additionally, this block 72 generates the necessary control signals for the Up/Mirror Control block 77, which is described below. The next block 73 is the $G_j(t)$—Function calculator, which is responsible for calculating the GAO-function of the column voltage as given in Eq. (1). Its inputs are the pixel state $a_{i,j}$ from the $G_j$-Control block 72 and the orthogonal function $F_i$ which are provided from an external source that is not shown. This $G_j(t)$-function is provided to the Up/Mirror control 77 and the next block 74 that registers the GAO-function with the beginning of the next row selection time. In the block 75 the GAO-function which is represented by three signals, is incremented or decremented by one. The output of the incrementing/decrementing block 75 is supplied to the decoder 76. The decoder 76 decodes the coded column voltage level and activates the enable signal that corresponds to the column voltage level for driving the respective column. The Up/Mirror Control block 77 derives based on the output of the G(t)-Function calculator 73 and the control signals from the GS-Control block 72 as well as the current column level whether or not the waveform in the following row selection time needs to be mirrored or not. Based on this information and additional information obtained from the GS-Control block 72, the Up/Mirror Control block 77 controls the +1/−1 block 75 that increases or decreases whenever and as long as needed the column voltage by one level.

In the following the rules are given which have to be fulfilled in order to obtain a column waveform with at most one transition during a row selection time, whereby the transition is only to the next lower or higher column level:

All code parts of the different grey scale codes which have—after grouping together all zeros and ones in the respective code—a change in their code within a frame/phase need to be concentrated in a certain number of phases, the so-called PWM-phases.

The number of PWM-phases in the grey scale table has to be less than or equal to the integer value of the number of frames used for FRC divided by the number of concurrently selected rows of the MRA scheme.

The number of PWM-phases per column in the phase mixing table in any frame has to be less or equal to one. Note that in case the phase mixing table has more than p rows then always p consecutive rows—counted from the top—must have less than or equal to one PWM-phase.

The number of the frames used for frame rate control has to be equal to or larger than the number of concurrently selected rows of the MRA scheme.

The number of rows in the phase mixing table has to be equal to or larger than the number of concurrently selected rows of the MRA scheme.

A further example that fulfils above requirements uses p=4 concurrently driven or selected rows and $n_{frc}$=8 frames. In this case the code parts in the grey scale table having a change within a phase can be arranged in two PWM-phases. But also in this case the number of transitions in the column voltage signal does not exceed at most one transition. Further the column voltage signal will only increase or decrease by one level.

In case one or more of these rules are not fulfilled, then the number of transitions during a row selection time may increase. Furthermore, also the step-size of these transitions may become larger than one. However, the maximum number of transitions per row selection time may still be considerably lower than in the state-of-the-art case.

So in a case having the number of concurrently driven rows chosen to be p=8 and having the number of frames used for frame rate control chosen to be $n_{frc}$=4, at most two transition during a row selection time will occur. This is still an improvement in respect to the prior art. Thereby in the case of two transitions, the transitions increase or decrease the column voltage level to the next upper or lower column voltage level, whereas in the case of one transition, the transition increases or decreases the column voltage level to the over-next upper or lower level.

In the following an example is given, illustrating that it is sufficient to calculate Eq. (1) only once per row selection time:

Given is that pixel $p_{0,0}$ should be displayed with grey scale 1, pixel $p_{1,0}$ with grey scale 6, pixel $p_{2,0}$ with grey scale 11, and pixel $p_{3,0}$ with grey scale 15 and provided is that the grey scale table of Table 3 and the phase mixing table of Table 4 are used.

From Table 4 we learn that for frame 0 pixel $p_{0,0}$ has to be driven according to phase 0, pixel $P_{1,0}$ according to phase 2, pixel $p_{2,0}$ according to phase 1, and pixel $p_{3,0}$ according to phase 3.

From Table 3 we learn that pixel $p_{0,0}$ for phase 0 and for grey scale 1 has to be driven over the four row sub selection time slots with the pixel state sequence $a_{0,0}=\{0, 0, 0, 0\}$. Pixel $p_{1,0}$ for phase 2 and grey scale 6 with the pixel state sequence $a_{1,0}=\{0, 0, 0, 0\}$. Pixel $p_{2,0}$ for phase 1 and grey scale 11 with the pixel state sequence $a_{2,0}=\{1, 1, 1, 1\}$ and pixel $p_{3,0}$ for phase 3 and grey scale 15 with the pixel state sequence $a_{3,0}=\{1, 1, 1, 0\}$.

Substituting in Eq. (1) in a first step $a_{0,0}$, $a_{1,0}$, $a_{2,0}$, and $a_{3,0}$ by the first elements of the respective pixel state sequence and in a second step by the second elements of the respective sequence and so on, reveals that the first three of the resulting equations-end up to look the same. Only the last equation differs from the previous ones. Since the difference between the last and the former equations pertains only to one product, it is sufficient to calculate Eq. (1) and therewith $G_j(t)$ only once. The result of the other equation can then be derived by simply incrementing or decrementing the result of the calculated equation by one.

The invention claimed is:

1. Display device comprising:

a liquid crystal material between a first substrate provided with row electrodes and a second substrate provided with column electrodes, in which overlapping parts of the row and column electrodes define pixels;

driving means for driving the column electrodes in conformity with an image to be displayed, wherein column voltages $G_j(t)$ are supplyable to the column electrodes, wherein the column voltages $G_j(t)$ to be supplied are selectable from a predetermined number of column voltages levels; and driving means for driving the row electrodes, wherein the row electrodes supply groups of p rows (p>=1) with mutually orthogonal selection signals for driving pixels and the groups of p rows are driven for the duration of a row selection time $p \times n_{frc}$ during a superframe including $n_{frc}$ frames for generating grey scales, wherein the row selection time is subdivided in $n_{pwm}$ sub selection time slots and the grey scales are coded in grey scale tables having $n_{frc}$ phases with $n_{pwm}$ sub selection time slots, wherein for the $n_{frc}$ frames of the superframe the grey scales are generated by using phase mixing, defining which phase of grey scale coding is used for a certain frame, wherein a column voltage $G_j(t)$ is calculated depending on the grey scales to be displayed by the p concurrently driven pixels in a column and depending on the used mutually orthogonal selection signals $F_i$ for the corresponding group of rows, wherein a change in the column voltage level is defining a transition, and wherein the column voltage GM) to be supplied to a column electrode has always less transitions per row selection time than the number $n_{pwm}$ of sub selection time slots of the row selection time.

2. Display device as claimed in claim 1, wherein the column voltage $G_j(t)$ to be supplied to a column electrode during a row selection time changes at most twice within a row selection time by at most one column voltage level or once by two column voltage levels.

3. Display device as claimed in claim 1, wherein the column voltage $G_j(t)$ to be supplied to a column electrode during a row selection time is calculated once per row selection time, wherein transitions in the column voltage $G_j(t)$ during the row selection time are provided by increasing or decreasing the column voltage level by the respective number of column voltage levels.

4. Display device as claimed in claim 1, wherein the grey scale table comprises a binary code for each of the x grey scales, each grey scale code appears only once, wherein the x grey scale codes are arranged in $n_{frc}$ phases, each phase having $n_{pwm}$ sub selection time slots, wherein all logical ones and zeros within each of these grey scale codes are grouped together such that the groups of logical ones or zeros in all grey scale codes are left-aligned or right-aligned, wherein the grey scale codes having a change from logical one to zero or vice versa within a phase are arranged, such that that part of the grey scale code that has the change within the phase is assigned to specific phases of the grey scale table, called PWM-phases.

5. Display device as claimed in claim 4, wherein the grey scale codes, in the phases other than the PWM-phase do not have a change in the code during the respective phases and therefore do themselves not provoke a transition of the column voltage $G_j(t)$.

6. Display device as claimed in claim 1, wherein the phase mixing is based on phase mixing tables, which are stored, whereby a phase mixing table defines the phase in the grey scale table for a certain pixel and a certain frame.

7. Display device as claimed in claim 6, wherein the PWM-phase in the phase mixing table, appears only once per column in a phase mixing table for a group of p rows per frame.

8. Display device as claimed in claim 1, whereby the column voltage $G_j(t)$ for each sub selection time slot that is part of the row selection time during which the corresponding p rows are selected, is calculated using the equation $$G_j(t) = \frac{1}{\sqrt{N}}\{a_{0,j} * F_0(t) + a_{1,j} * F_1(t) + \ldots + a_{p-1,j} * F_{p-1}(t)\}$$

whereby N is the number of rows of the display, $F_i(t)$ are the orthogonal functions to be supplied to the row electrodes during the row selection time and $a_{i,j}$ are the pixel states with i as an index for the row given as the row number modulo 4 and j as an index for the column, wherein the coded grey scales in the grey scale tables and the used phase mixing tables are adapted that the calculation of the column voltage GM) needs only to be performed once per row selection time, wherein a change in the grey scale code of a certain pixel is realized by an increasing or decreasing of the column voltage level by one.

9. Display device as claimed in claim 1, wherein the column voltage $G_j(t)$ to be supplied to a column electrode during a row selection time is calculated once per row selection time and a transition in the column voltage GM) within a row selection time is realized by increasing or decreasing the calculated column voltage level by one level.

10. Display device as claimed in claim 1, wherein a mirroring of the column voltage waveform is performed by calculating the column voltage GM) for the subsequent row selection time during the current row selection time.

11. Display device as claimed in claim 10, wherein the column voltage waveform is mirrored on a mirror axis in the middle of a row selection time.

12. Display device as claimed in claim 10, wherein the mirroring is performed adaptively only when the column voltage $G_j(t)$ at the end of the current row selection time is the same as the column voltage at the end of the following row selection time.

13. Method for driving a display device as claimed in claim 1.

* * * * *